US008001800B2

(12) United States Patent
Kashiwa et al.

(10) Patent No.: US 8,001,800 B2
(45) Date of Patent: Aug. 23, 2011

(54) OUTDOOR UNIT OF AIR CONDITIONER

(75) Inventors: Shirou Kashiwa, Kusatsu (JP); Takashi Tanba, Kusatsu (JP); Toshiyuki Imanaka, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 507 days.

(21) Appl. No.: 12/094,619

(22) PCT Filed: Nov. 21, 2006

(86) PCT No.: PCT/JP2006/323154

§ 371 (c)(1),
(2), (4) Date: May 22, 2008

(87) PCT Pub. No.: WO2007/060927

PCT Pub. Date: May 31, 2007

(65) Prior Publication Data

US 2008/0307816 A1 Dec. 18, 2008

(30) Foreign Application Priority Data

Nov. 25, 2005 (JP) ..... 2005-340175

(51) Int. Cl.
*F25D 23/12* (2006.01)

(52) U.S. Cl. ..... 62/259.1; 62/259.2; 62/428

(58) Field of Classification Search ..... 62/259.1, 62/259.2, 498, 314, 428, 414, 419
See application file for complete search history.

(56) References Cited

U.S. PATENT DOCUMENTS

| | | | | | |
|---|---|---|---|---|---|
| 2,655,795 | A | * | 10/1953 | Dyer | 62/179 |
| 4,204,409 | A | * | 5/1980 | Satama | 62/271 |
| 4,815,530 | A | * | 3/1989 | Scott | 165/134.1 |
| 5,097,678 | A | * | 3/1992 | Aubuchon | 62/506 |
| 7,263,855 | B2 | * | 9/2007 | Meyer et al. | 62/371 |

FOREIGN PATENT DOCUMENTS

| | | | |
|---|---|---|---|
| JP | 4-302930 | A | 10/1992 |
| JP | 7-63376 | A | 3/1995 |
| JP | 9-126496 | A | 5/1997 |
| JP | 2002-106886 | A | 4/2002 |

* cited by examiner

*Primary Examiner* — Mohammad Ali
(74) *Attorney, Agent, or Firm* — Birch, Stewart, Kolasch & Birch, LLP.

(57) ABSTRACT

Fixed part 21 of a shield panel 20 is fixed to a casing 1 in vicinity of a lower edge of an opening 15. In the shield panel 20, a portion of step part 22 adjoining the fixed part 21, flat part 23 and bent part 24 are placed inside the casing 1. Extremity of the bent part 24 is in contact with an inner side surface of the casing 1 in vicinity of an upper end of the opening 15. Thus invasion of flame into the casing 1 through the upper end of the opening 15 is prevented. Besides, gaps as air circulation paths that are formed between side edges of the opening 15 and the flat part 23 of the shield panel 20 provide ventilation in the casing 1 and improve efficiency of cooling electrical components in an electrical component box 10.

4 Claims, 6 Drawing Sheets

OUTDOOR UNIT OF AIR CONDITIONER

TECHNICAL FIELD

The present invention relates to an outdoor unit of an air conditioner and particularly to an outdoor unit of an air conditioner of which flameproof capacity and efficiency of cooling electrical components can be improved.

BACKGROUND ART

Conventionally, an outdoor unit and an indoor unit of an air conditioner are connected to each other through refrigerant pipes and electrical interconnections. Through the refrigerant pipes, refrigerant is circulated among a heat exchanger that is provided in the indoor unit, and a compressor, a heat exchanger and an expander that are provided in the outdoor unit. Through the electrical interconnections, electric power is supplied from the indoor unit to the outdoor unit and control signals are communicated between the indoor unit and the outdoor unit.

FIG. 6 is a cross-section showing a portion of a conventional outdoor unit of an air conditioner and showing vicinity of connections between the electrical interconnections and the outdoor unit (JP 7-63376 A).

In the conventional outdoor unit of the air conditioner, as shown in FIG. 6, an interconnection opening 121 is provided on a side surface of a main frame 101 of the outdoor unit and is closed by a flat-plate-like interconnection cap 117 having swelling part formed in lower end part thereof. A connector 113 connected to an electrical component 112 is provided in a position in the main frame 101 of the outdoor unit facing the interconnection opening 121, and electrical interconnections 116 connected to the indoor unit not shown are connected to the connector 113. The electrical interconnections 116 are drawn to outside of the main frame 101 of the outdoor unit through a gap between the swelling part of the interconnection cap 117 and the outer side surface of the main frame 101 of the outdoor unit and extend downward along the outer side surface of the main frame 101 of the outdoor unit. The opening cap 117 and the electrical interconnections 116 are overlaid by a cover 11B made of synthetic resin.

In the interconnection cap 117, lower end part is screwed onto the main frame 101 of the outdoor unit and upper end part is pressed by the cover 118 against the outer side surface of the main frame 101 of the outdoor unit.

The conventional outdoor unit of the air conditioner, however, has a problem of poor flameproof capacity. In case of fire occurring in vicinity of the outdoor unit, specifically, the resin cover 118 might be burned or melted by flame. Subsequently, the upper end part of the opening cap 117 pressed by the cover 118 might come off from the outer side surface of the main frame 101 of the outdoor unit and upper end part of the interconnection opening 121 might be thereby exposed. Flame might invade inside of the main frame 101 of the outdoor unit through the exposed upper end part of the interconnection opening 121, so that the connector 113, the electrical components 112 and the like positioned in vicinity of the interconnection opening 121 might take fire.

In the conventional outdoor unit of the air conditioner, the interconnection opening 121 of the main frame 101 closed by the flat-plate-like interconnection cap 117 makes it difficult to ventilate the unit and to exposed to airflow the electrical components 112 positioned in vicinity of the interconnection opening 121. Accordingly, there is caused a problem of a low efficiency of cooling the electrical components 112.

SUMMARY OF THE INVENTION

It is an object of the present invention to provide an outdoor unit of an air conditioner of which flameproof capacity and efficiency of cooling electrical components therein are improved.

In order to achieve the object, an outdoor unit of an air conditioner of the invention comprises:

a heat exchanger, a compressor, an electrical component box, a casing that houses the heat exchanger, the compressor, and the electrical component box and that has an opening adjacent to the electrical component box, and an opening cover which forms air circulation paths between the opening cover and side edges of the opening, which extends between part of the casing on upper end side of the opening and part of the casing on lower end side of the opening, and in which an interconnection path guiding from inside to outside of the casing interconnections connected to electrical components in the electrical component box is provided in lower end part thereof.

In above configuration, the opening cover is provided on the opening that is provided on the casing so as to be in proximity to the electrical component box, and the opening cover extends between the part of the casing on the upper end side of the opening and the part of the casing on the lower end side of the opening. In case of fire occurring in vicinity of the outdoor unit of the air conditioner, a portion of the opening cover that is positioned on the part of the casing on the upper end side of the opening prevents invasion of flame into the casing through upper end of the opening. Thus the electrical components in the electrical component box adjacent to the opening can be prevented from taking fire. Though the air circulation paths are formed between the side edges of the opening and the opening cover, a sufficient flameproof capacity can be obtained only with the prevention of invasion of flame through the upper end of the opening because it is difficult for flame to invade inside of the casing through the side edges of the opening.

The air circulation paths formed between the opening cover and the side edges of the opening provide ventilation therethrough into the casing. Thus the electrical components in the electrical component box adjacent to the opening can effectively be cooled by the ventilation and efficiency of cooling the electrical components can be made higher than that of conventional units.

In one embodiment, upper end part of the opening cover is in contact with an inner side surface of the casing while the lower end part of the opening cover is fixed onto an outer side surface of the casing.

In the embodiment, the lower end part of the opening cover is fixed onto the outer side surface of the casing and the upper end part of the opening cover is thereby brought into contact with the inner side surface of the casing. Thus the opening cover can easily be mounted onto the opening of the casing while flameproof capacity superior to that of conventional units is obtained.

In the opening cover that is not yet mounted to the casing, particularly, a portion of the upper end part that is to be in contact with the inner side surface of the casing preferably protrudes to a side corresponding to outside of the casing from the surface of the lower end part that is to be fixed to the casing. Once the opening cover is mounted to the casing, accordingly, the upper end part can easily be brought into close contact with the inner side surface of the casing by a spring force exerted by the opening cover.

In one embodiment, the opening cover comprises:

fixed part that is fixed onto the outer side surface of the casing, step part that adjoins the fixed part and that extends from outside to inside of the casing in vicinity of a lower edge of the opening of the casing, flat part that adjoins the step part and that is placed inside the casing with respect to the opening of the casing, and bent part that adjoins the flat part and that is bent from the flat part so that extremity thereof comes into contact with the inner side surface of the casing in vicinity of an upper edge of the opening.

In the embodiment, the fixed part of the opening cover is fixed onto the outer side surface of the casing and then the step part of the opening cover extends from outside to inside of the casing in vicinity of the lower edge of the opening. Thus the flat part that adjoins the step part is placed inside the casing with respect to the opening of the casing. There are formed gaps and thus air circulation paths between the flat part and the side edges of the opening of the casing, so that ventilation through the air circulation paths is provided in the casing. As a result, the efficiency of cooling the electrical components in the electrical component box adjacent to the opening can be improved.

Besides, the extremity of the bent part that adjoins the flat part comes into contact with the inner side surface of the casing in vicinity of the upper edge of the opening. Thus a gap between the upper edge of the opening of the casing and the opening cover is blocked, invasion of flame into the casing can be prevented, and the flameproof capacity of the outdoor unit of the air conditioner can be improved.

In the opening cover that is not yet mounted to the casing, particularly, the extremity of the bent part preferably protrudes to the side corresponding to outside of the casing from the surface of the fixed part that is to be fixed to the casing. Once the opening cover is mounted to the casing, accordingly, the extremity of the bent part can easily be brought into close contact with the inner side surface of the casing by a spring force exerted by the step part, the flat part and the like.

In one embodiment, the opening cover comprises side walls ranging and rising from side edges of the flat part.

In the embodiment, the side walls narrow the gaps between the side edges of the opening of the casing and the opening cover, so that invasion of flame through the opening into the casing can effectively be prevented. Size of the side walls may be determined on basis of a quantity of ventilation and flameproof effect that are to be attained in the casing.

In one embodiment, a size of the flat part of the opening cover in a direction of width is larger than a distance between the opposed side edges of the opening of the casing.

In the embodiment, the size in the direction of width of the flat part placed inside the casing is larger than the distance between the opposed side edges of the opening, so that the flat part of the opening cover exists on the side edges of the opening in a front view of the opening cover. This makes it difficult for flame outside the casing to make a detour through the air circulation paths between the side edges of the opening and the opening cover and to invade inside of the casing, so that the flameproof capacity of the outdoor unit of the air conditioner can be improved.

As described above, the outdoor unit of the air conditioner of the invention has the opening that is provided on the casing so as to be in proximity to the electrical component box in the casing, and has the opening cover that extends between the part of the casing on the upper end side of the opening and the part of the casing on the lower end side of the opening. Thus the flameproof capacity can be improved by the prevention of invasion of flame into the casing through the upper end of the opening and the efficiency of cooling the electrical components in the electrical component box adjacent to the opening can be improved by the ventilation in the casing through the air circulation paths formed between the side edges of the opening and the opening cover.

DETAILED DESCRIPTION OF THE INVENTION

Embodiments of the invention will now be described in detail with reference to the accompanying drawings.

Figure 1:
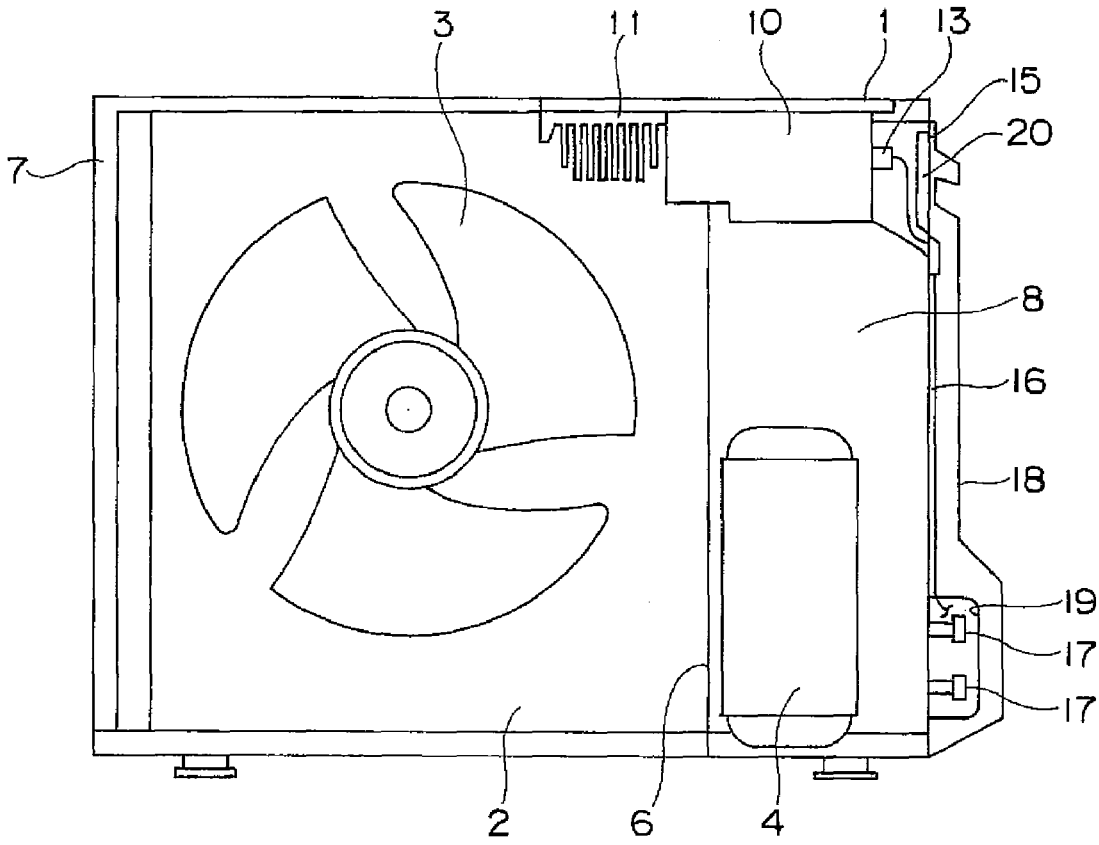
FIG. 1 is a section schematically showing inside of an outdoor unit of an air conditioner that is an embodiment of the invention.

FIG. 1 is a section schematically showing inside of an outdoor unit of an air conditioner that is an embodiment of the invention.

In a casing 1 of the outdoor unit of the air conditioner are contained a heat exchanger 2 for performing heat exchange between refrigerant and outdoor air, a fan 3 for delivering outdoor air to the heat exchanger 2, and a compressor 4 for compressing the refrigerant. Inside of the casing 1 is partitioned by a partition panel 6 into a heat exchanger chamber 7 housing the heat exchanger 2 and a compressor chamber 8 housing the compressor 4.

In upper part in the casing 1, an electrical component box 10 is provided so as to stretch from the heat exchanger chamber 7 to the compressor chamber 8. In the electrical component box 10 are housed a power circuit for supplying electric power to the fan 3, the compressor 4 and the like, and a control circuit for controlling operation of the fan 3, the compressor 4 and the like. The power circuit and the control circuit correspond to electrical components of the invention. Onto a side surface of the electrical component box 10 on side of the heat exchanger chamber 7 is connected a fin 11 for radiating heat produced chiefly in the power circuit. On a side surface of the electrical component box 10 on side of the compressor chamber 8 is provided a terminal 13 connected to the power circuit and to the control circuit. To the terminal 13 are connected electrical interconnections 16 connected to an indoor unit not shown. Through the electrical interconnections 16, electric power is supplied from the indoor unit and communication between the indoor unit and the outdoor unit is performed.

On a side surface of the casing 1 is provided an opening 15 adjacent to the terminal 13. A shield panel 20 as an opening cover is mounted onto the opening 15, and the electrical interconnections 16 are guided from outside to inside of the casing 1 through an interconnection path 25 provided on the shield panel 20. On an upper edge of the opening 15 is provided an opening bend 15*a* (shown in FIG. 2) bent toward inside of the casing 1. In vicinity of a lower end of the side surface of the casing 1, closure valves 17 to which refrigerant pipes for guiding refrigerant are to be connected protrude from inside of the casing 1. The refrigerant pipes connected to the indoor unit are connected to the closure valves 17, and then opening the valves 17 provides connection among the compressor 4, the heat exchanger 2 and the expander of the outdoor unit, and the heat exchanger of the indoor unit, which form a refrigerant circuit. A direction of circulation of the refrigerant is switched by a four-way switching valve or the like provided in the refrigerant circuit, and a function of the heat exchanger 2 of the outdoor unit is thereby switched between a condenser and an evaporator, so that cooling operation and heating operation are performed.

On the side surface of the casing 1, an oblong outer cover 18 made of resin is mounted so as to cover a center portion of width and generally overall height of the side surface. In the outer cover 18 are housed the shield panel 20 provided on the opening 15, the closure valves 17 and part of the electrical interconnections 16. That is, the opening 15 of the casing 1 is formed in an area covered by the outer cover 18. On back side of the outer cover 18 in FIG. 1 is provided a guide port 19 for guiding the refrigerant pipes and the electrical interconnections 16 to the inside. Louvers 18*a* (shown in FIG. 2) for ventilation are provided in a region on the outer cover 18 below a region corresponding to the opening 15.

Figure 2:
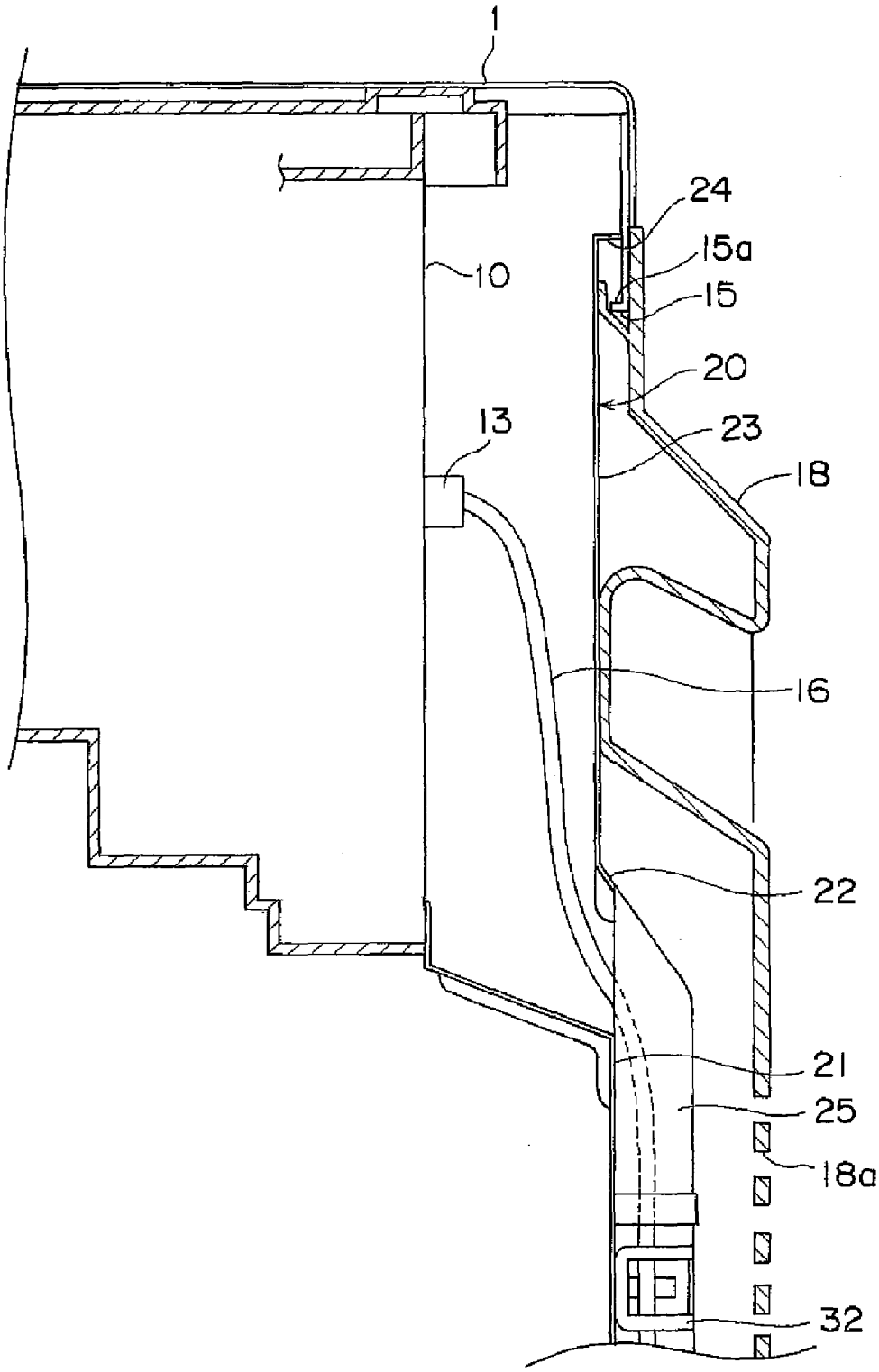
FIG. 2 is an enlarged section showing surroundings of an opening of a casing and a shield panel.
Figure 3:
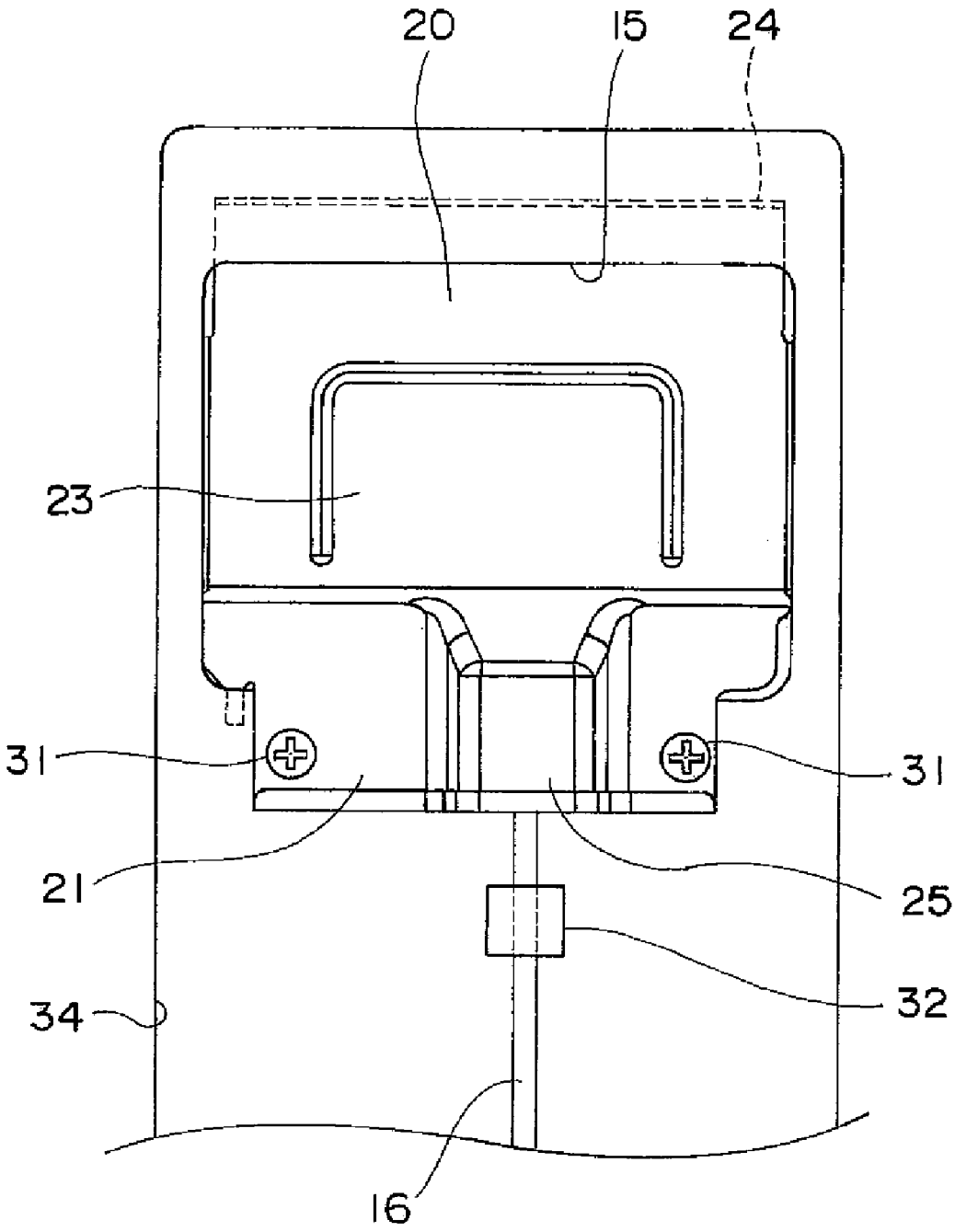
FIG. 3 is a front view schematically showing the opening of the casing and the shield panel.

FIG. 2 is an enlarged cross-section showing surroundings of the opening 15 of the casing and the shield panel 20 in FIG. 1, and FIG. 3 is a front view showing a portion of the side surface of the casing 1 and schematically showing vicinity of the opening 15 and the shield panel 20.

As shown in FIGS. 2 and 3, the shield panel 20 having generally the same width as the opening 15 has and having a height larger than that of the opening 15 is mounted on the opening 15 on the side surface of the casing 1. Thus the shield panel 20 extends between part of the casing 1 on lower end side of the opening 15 and part of the casing 1 on upper end side of the opening 15. In FIG. 3 is shown the portion of the side surface of the casing 1 from which the outer cover 18 has been removed. Flat part 23 and bent part 24 of the shield panel 20 that are upper parts in FIGS. 2 and 3 are placed inside the casing 1, while fixed part 21 of the shield panel 20 that is lower part is placed on the surface of the casing 1 and is screwed onto the casing 1 by screws 31 in that state. The electrical interconnections 16 drawn out from inside to outside of the casing 1 through the interconnection path 25 provided on the fixed part 21 are fixed onto the surface of the casing 1 by an interconnection band 32 below the shield panel 20. One end of the electrical interconnections 16 is connected to the electrical component box 10 through the connector 13. In FIG. 3, reference number 34 denotes an outer edge of a recess formed on the side surface of the casing 1, and the recess is covered by the outer cover 18.

Figure 4:
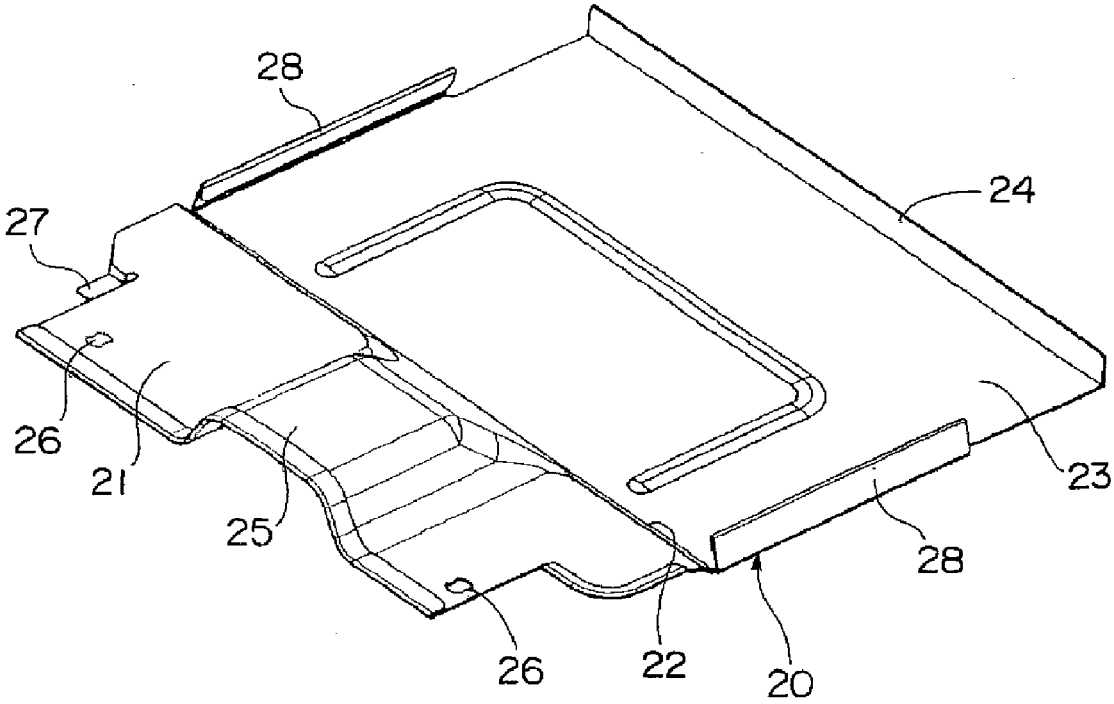
FIG. 4 is a perspective view showing the shield panel.
Figure 5:
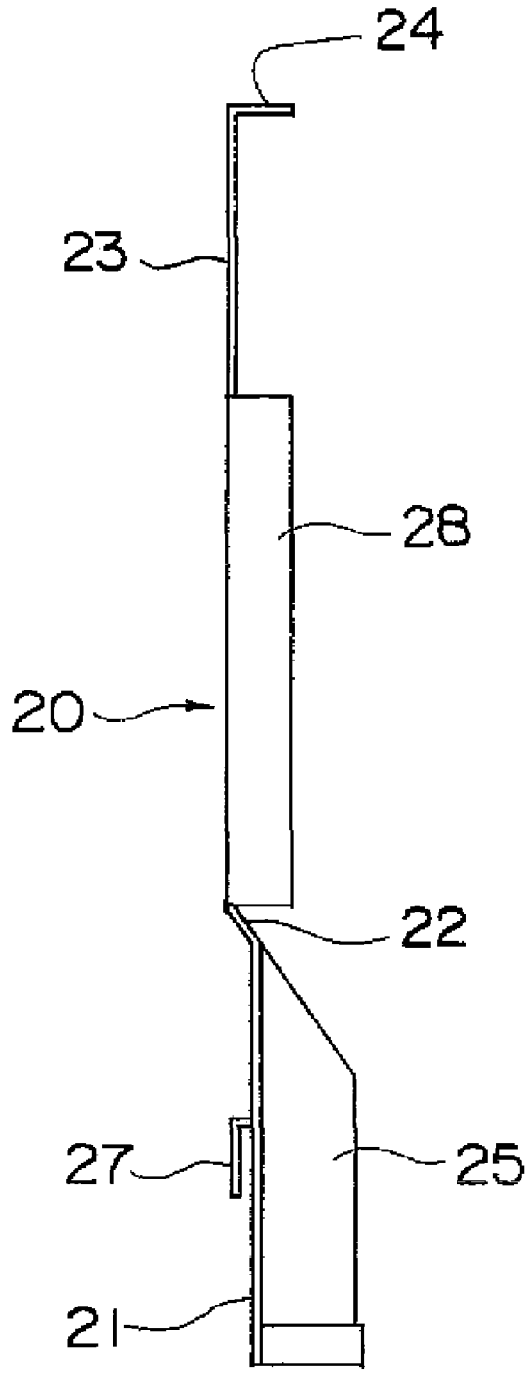
FIG. 5 is a side view of the shield panel.
Figure 6:
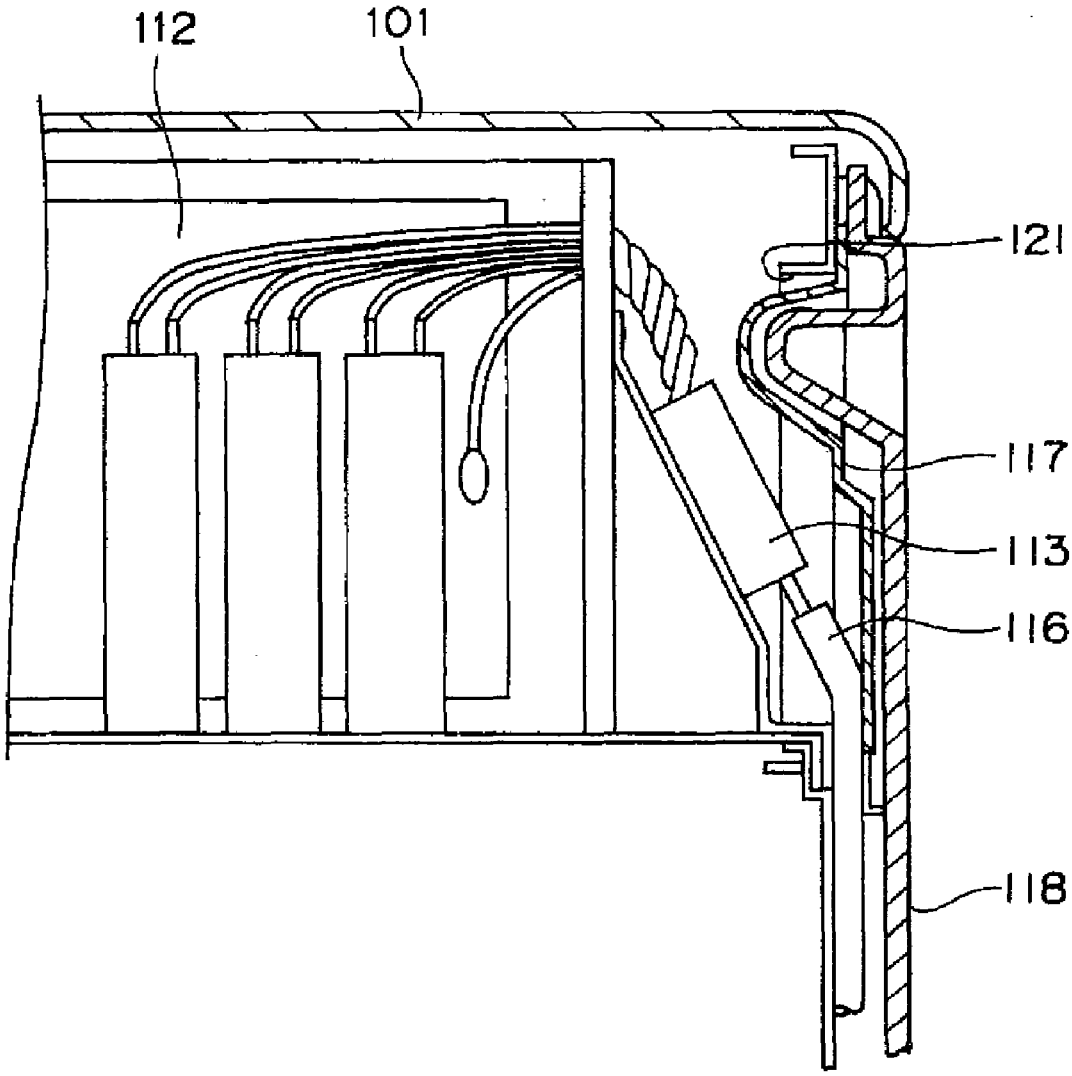
Fig.6 PRIOR ART
FIG. 6 is a section showing a portion of a conventional outdoor unit of an air conditioner.

FIG. 4 is a perspective view showing the shield panel 20, and FIG. 5 is a side view of the shield panel 20.

As shown in FIGS. 4 and 5, the shield panel 20 is composed of the fixed part 21, step part 22, the flat part 23 and the bent part 24 that range in sequence.

The fixed part 21 is generally shaped like a letter T, and the interconnection path 25 that is formed so as to extend vertically and so as to swell further from other parts is provided in a position deviated rightward from center of a width thereof as seen looking from front side. Screw holes 26 through which the screws 31 are inserted as shown in FIG. 3 are provided on both left and right sides of the interconnection path 25 and adjacent to a lower edge of the fixed part 21. With the fixed part 21 fixed onto the casing 1, a back surface thereof comes into contact with the surface of the casing 1. From a lower edge of a left arm of the T-shaped fixed part 21 extends downward an engagement pawl 27 having a backward step with respect to a plane on which the fixed part 21 extends. The engagement pawl 27 engages with an edge of the opening 15 (shown in FIGS. 2 and 3) and a position in which the shield panel 20 is mounted on the opening 15 is thereby defined.

The step part 22 is slanted so as to make an obtuse angle with the fixed part 21 on the back surface side thereof. The step part 22 forms a difference in level such that the flat part 23 is positioned on the back side relative to the fixed part 21.

The flat part 23 extends generally in parallel to the fixed part 21. In the flat part 23, part or all thereof including its end on side of the bent part 24 may be inclined toward an extremity of the bent part 24 with respect to the fixed part 21. The spring force by which the extremity of the bent part 24 is pressed against the inner side surface of the casing 1 is thereby strengthened so that the extremity of the bent part 24 can reliably be brought into close contact with the inner side surface of the casing 1. On both left and right edges of the flat part 23 as seen looking from front side are provided side walls 28 that extend from the step part 22 toward the bent part 24 so as to have a length about two thirds that of the edges. The left and right side walls 28 are bent frontward, as seen looking from the front side, so as to make angles on the order of 75° with the flat part 23. When the shield panel 20 is mounted on the opening 15 of the casing 1, accordingly, the side walls 28 come into contact with lower portions of both side edges of the opening 15 so as to block lower portions of both sides of the opening 15. The length of the side walls 28 may have any ratio to that of the side edges of the flat part 23, and the side walls 28 do not have to be in close contact with both the side edges of the opening 15. Size and shape of the side walls 28 may be determined on basis of a quantity of ventilation and flameproof effect that are to be attained in the casing 1. The side walls 28 may be omitted. In the unit in which the side walls 28 are not provided, air circulation paths are formed between overall both the side edges of the opening 15 and the shield panel 20.

The bent part 24 makes a generally right angle with the flat part 23 and is bent frontward as seen looking from the front side. The extremity of the bent part 24 protrudes toward front surface side from an imaginary plane that is an extension of the back surface of the fixed part 21 in contact with the outer side surface of the casing 1. With the fixed part 21 fixed onto the outer side surface of the casing 1, accordingly, the spring force exerted by the step part 22 and the flat part 23 brings the extremity of the bent part 24 into close contact with the inner side surface of the casing 1.

In case of fire occurring in vicinity of the outdoor unit of the air conditioner having above configuration, the outdoor unit is more resistant to invasion of flame into inside of the indoor unit and has greater flameproof capacity in comparison with conventional outdoor units. In case of fire occurring in vicinity of the casing 1, specifically, the outer cover 18 might be burned or melted, the side surface of the casing 1 might be exposed, and the opening 15 of the casing and the shield panel 20 might be exposed to flame. Then the shield panel 20 blocks the upper end part of the opening 15 with the bent part 24 in contact with the inner side surface of the casing 1 adjacent to the upper end part of the opening 15. The opening 15 having the upper end part blocked in this manner resists invasion of flame into inside of the casing 1. Besides, the opening bend 15*a* provided on the upper edge of the opening 15 resists intrusion of flame to the upper end of the shield panel 20. Thus the outdoor unit of the air conditioner effectively prevents invasion of flame into the casing 1 through the opening 15, consequently prevents the electrical components adjacent to the opening 15 from taking fire, and has greater flameproof capacity than conventional outdoor units have.

Furthermore, the outdoor unit of the air conditioner having the above configuration provides a better performance of cooling the electrical components than conventional outdoor units. Specifically, the flat part 23 of the shield panel 20 provided on the opening 15 is positioned inside the casing 1, so that the gaps and thus the air circulation paths are formed between both the side edges of the opening 15 and the edges of the flat part 23 of the shield panel 20 on which the side walls 28 are not formed. The ventilation in the casing 1 is provided through the air circulation paths. By the ventilation, the power circuit and the control circuit in the electrical component box 10 positioned in vicinity of the opening 15 can be cooled at higher efficiency than in conventional units.

Though the air circulation paths are formed between upper parts of both the side edges of the opening 15 and the shield panel 20 with the side walls 28 provided on lower parts of the flat part 23 of the shield panel 20 in the embodiment, air circulation paths may be formed between overall both the side edges of the opening 15 and the shield panel 20 without provision of the side walls 28 on the shield panel 20.

Though the size of the flat part 23 of the shield panel 20 in the direction of the width is generally as large as a distance between both the side edges of the opening 15 of the casing 1 in the embodiment as shown in FIG. 3, the size of the flat part 23 in the direction of the width may be larger than the distance between both the side edges of the opening 15. In this configuration, the flat part 23 resides over the side edges of the opening 15 in front view of the shield panel 20, so that the air circulation paths are formed between vicinity of the edges of a front face of the flat part 23 and the inner side surface of the casing 1 adjacent to the opening 15. The air circulation paths are formed in parallel to a plane of the flat part 23. This makes it difficult for flame outside the casing 1 to make a detour to inside of the casing 1 through the air circulation paths and further improves the flameproof capacity of the outdoor unit of the air conditioner.

The opening bend 15*a* provided on the upper edge of the opening 15 of the casing 1 may be omitted.

The shield panel 20 is fixed to the casing 1 by the screws 31 inserted through the screw holes 26 on the fixed part 21 of the shield panel 20, nevertheless the shield panel 20 may be fixed to the casing 1, e.g., by engagement pawls or the like provided on the fixed part or the casing 1 without the provision of the screw holes 26 on the fixed part 21.

The invention claimed is:

1. An outdoor unit of an air conditioner, the outdoor unit comprising:

a heat exchanger, a compressor, an electrical component box, a casing that houses the heat exchanger, the compressor, and the electrical component box and that has an opening adjacent to the electrical component box, and an opening cover which forms air circulation paths between the opening cover and side edges of the opening, which extends between part of the casing on upper end side of the opening and part of the casing on lower end side of the opening, and in which an interconnection path guiding from inside to outside of the casing interconnections connected to electrical components in the electrical component box is provided in lower end part thereof, wherein the opening cover comprises:

fixed part that is fixed onto the outer side surface of the casing, step part that adjoins the fixed part and that extends from outside to inside of the casing in vicinity of a lower edge of the opening of the casing, flat part that adjoins the step part and that is placed inside the casing with respect to the opening of the casing, and bent part that adjoins the flat part and that is bent from the flat part so that extremity thereof comes into contact with the inner side surface of the casing in vicinity of an upper edge of the opening.

2. The outdoor unit of the air conditioner as claimed in claim 1, wherein the opening cover comprises side walls ranging and rising from side edges of the flat part.

3. The outdoor unit of the air conditioner as claimed in claim 1, wherein a size of the flat part of the opening cover in a direction of width is larger than a distance between the opposed side edges of the opening of the casing.

4. An outdoor unit of an air conditioner, the outdoor unit comprising:

a heat exchanger, a compressor, an electrical component box, a casing that houses the heat exchanger, the compressor, and the electrical component box and that has an opening on a side surface thereof adjacent to the electrical component box, and an opening cover which extends between an inner side portion of the casing on upper end side of the opening and an outer side portion of the casing on lower end side of the opening, wherein the opening has an upper edge and both side edges extending downward from both sides of the upper edge, air circulation paths are formed between both the side edges of the opening and part of the opening cover inside the casing, and an interconnection path is provided in lower end part of the opening cover and guides from inside to outside of the casing interconnections connected to electrical components in the electrical component box.

* * * * *